US005564239A

United States Patent [19]

Mitsis

[11] Patent Number: 5,564,239

[45] Date of Patent: Oct. 15, 1996

[54] HORSE SHAPED BUILDING WITH RECREATIONAL AREA

[76] Inventor: Vagelis Mitsis, 66-68 Tritonos Street, Paleo Faliron, Athens, Greece

[21] Appl. No.: 600,093

[22] Filed: Feb. 12, 1996

[51] Int. Cl.[6] ..... E04H 3/00

[52] U.S. Cl. ..... 52/236.1; 52/234; 472/137

[58] Field of Search ..... 52/234, 236.3, 52/236.6, 750, 33, 36, 27, 236.1, 169.1, 169.7; 472/136, 137

[56] References Cited

U.S. PATENT DOCUMENTS

| | | | |
|---|---|---|---|
| 268,503 | 12/1882 | Cafferty | 52/236.1 X |
| 3,491,496 | 1/1970 | Johnston | 52/65 |
| 3,701,224 | 10/1972 | Mozier | 52/27 |
| 4,274,233 | 6/1981 | Currier | 52/33 |
| 4,905,326 | 3/1990 | Nakamura et al. | 52/169.7 X |
| 4,958,465 | 9/1990 | Levy | 52/169.1 |
| 5,193,648 | 3/1993 | Yuter | 186/38 |

*Primary Examiner*—Carl D. Friedman
*Assistant Examiner*—Creighton Smith
*Attorney, Agent, or Firm*—Richard L. Miller, P.E.

[57] ABSTRACT

A horse shaped building with recreational area that is inspired by Greek mythology wherein the horse shaped building replicates the Greek horse doureios ippos. The horse shaped building with recreational area includes an octagonal shaped garden, the horse shaped building, an octagonal shaped water canal, and a movably mounted stepped bridge. The horse shaped building is disposed on the octagonal shaped garden. The octagonal shaped water canal surrounds the octagonal shaped garden. And, the movably mounted stepped bridge extends from the octagonal shaped garden and passes over the octagonal shaped water canal.

20 Claims, 2 Drawing Sheets

HORSE SHAPED BUILDING WITH RECREATIONAL AREA

BACKGROUND OF THE INVENTION

The present invention relates to a horse shaped building with recreational area. More particularly, the present invention relates to a horse shaped building with recreational area that includes an octagonal shaped garden, a horse shaped building that is disposed on the octagonal shaped garden, an octagonal shaped water canal that surrounds the octagonal shaped garden, and a movably mounted stepped bridge that extends from the octagonal shaped garden and passes over the octagonal shaped water canal.

It is well recognized that the success of a recreational area is dependent not only upon the quality of food and service, but also upon the environment which is established by the physical structure. The appeal can be even further enhanced by an element of novelty and a body of water which is frequently regarded as establishing a particularly pleasing environment.

In greek mythology Doureios Ippos (the greek horse) is one of the most important expressions of greek ingenuity and the bravery of the ancient greeks, who succeeded in the unfeasible use of the mind instead of wealth, arms, and numerous armies.

Numerous innovations for buildings with restaurants have been provided in the prior art that will be described. However, even though these innovations may be suitable for the specific individual purposes to which they address, they differ from the present invention in that they do not teach a horse shaped building with recreational area that includes an octagonal shaped garden, a horse shaped building that is disposed on the octagonal shaped garden, an octagonal shaped water canal that surrounds the octagonal shaped garden, and a movably mounted stepped bridge that extends from the octagonal shaped garden and passes over the octagonal shaped water canal.

For example, U.S. Pat. No. 3,491,496 to Johnston teaches a rotating restaurant that includes an annular turntable which is driven by rollers contacting with opposite sides of a downwardly extending flange. The turntable is supported by two sets of wheels arranged in concentric circles about the center of rotation of the turntable.

Another example, U.S. Pat. No. 3,701,224 to Mozier teaches a dining area for a restaurant that includes a body of water and a plurality of platforms in the form of boats disposed on the body of water and accessible by diners.

Still another example, U.S. Pat. No. 4,274,233 to Currier teaches a coordinated building layout that includes a restaurant and artist work/exhibit area.

Finally, yet another example, U.S. Pat. No. 5,193,648 to Yuter teaches a restaurant that includes a building with a first floor. A second floor consists of a terrace on three sides of the building forming an atrium between the terrace and the fourth side of the building. Both floors have dining tables and chairs with a telephone on a console on each side.

It is apparent that numerous innovations for buildings with restaurants have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a horse shaped building with recreational area that avoids the disadvantages of the prior art.

Another object of the present invention is to provide a horse shaped building with recreational area that is inspired by Greek mythology.

Still another object of the present invention is to provide a horse shaped building with recreational area that replicates the Greek horse doureios ippos.

Yet another object of the present invention is to provide a horse shaped building with recreational area that imitates ancient Greece in its high quality standards of style and services.

Still yet another object of the present invention is to provide a horse shaped building with recreational area that combines ancient Greek tradition with modern luxury.

Briefly stated, yet still another object of the present invention is to provide a horse shaped building with recreational area that includes an octagonal shaped garden, a horse shaped building, an octagonal shaped water canal, and a movably mounted stepped bridge.

Still yet another object of the present invention is to provide a horse shaped building with recreational area wherein the horse shaped building is disposed on the octagonal shaped garden.

Yet still another object of the present invention is to provide a horse shaped building with recreational area wherein the octagonal shaped water canal surrounds the octagonal shaped garden.

Still yet another object of the present invention is to provide a horse shaped building with recreational area wherein the movably mounted stepped bridge extends from the octagonal shaped garden and passes over the octagonal shaped water canal.

Yet still another object of the present invention is to provide a horse shaped building with recreational area wherein the octagonal shaped garden has a perimeter surrounded by a fence with an opening.

Still yet another object of the present invention is to provide a horse shaped building with recreational area wherein the fence of the perimeter of the octagonal shaped garden is a metal railing.

Yet still another object of the present invention is to provide a horse shaped building with recreational area wherein the octagonal shaped water canal has a perimeter surrounded by a fence with an opening.

Still yet another object of the present invention is to provide a horse shaped building with recreational area wherein the fence of the perimeter of the octagonal shaped water canal is a metal railing.

Yet still another object of the present invention is to provide a horse shaped building with recreational area wherein the movably mounted stepped bridge extends from the opening of the fence of the perimeter of the octagonal shaped garden to the opening of the perimeter of the fence of the octagonal shaped water canal.

Still yet another object of the present invention is to provide a horse shaped building with recreational area wherein the stepped bridge has a pair of sides.

Yet still another object of the present invention is to provide a horse shaped building with recreational area wherein each of a pair of fences is disposed at each of the pair of sides of the stepped bridge.

Still yet another object of the present invention is to provide a horse shaped building with recreational area wherein each of the pair of fences of the pair of sides of the stepped bridge intersects the fence of the perimeter of the octagonal shaped garden and the fence of the perimeter of the octagonal shaped water canal at extremes of the opening of the fence of the perimeter of the octagonal shaped garden and at extremes of the opening of the fence of the perimeter of the octagonal shaped water canal.

Yet still another object of the present invention is to provide a horse shaped building with recreational area wherein each of the pair of fences of the pair of sides of the stepped bridge are metal railings and the stepped bridge is marble of three different colors in a mosaic pattern.

Still yet another object of the present invention is to provide a horse shaped building with recreational area wherein the horse shaped building includes a body with a bottom, a back, a front, a top, and a plurality of windows.

Yet still another object of the present invention is to provide a horse shaped building with recreational area wherein a head extends upwardly from the top of the body of the horse shaped building at the front of the body of the horse shaped building.

Still yet another object of the present invention is to provide a horse shaped building with recreational area wherein the head of the horse shaped building has a pair of eyes and a snout with teeth.

Yet still another object of the present invention is to provide a horse shaped building with recreational area wherein the snout of the head of the horse shaped building is rotatively mounted in the head of the horse shaped building.

Still yet another object of the present invention is to provide a horse shaped building with recreational area wherein the pair of eyes of the head of the horse shaped building and the teeth of the snout of the head of the horse shaped building function as windows.

Yet still another object of the present invention is to provide a horse shaped building with recreational area wherein the head further has a stairway that extends from the top of the body of the horse shaped building through the head of the horse shaped building to a platform at the pair of eyes of the head of the horse shaped building and to a platform at the snout of the head of the horse shaped building.

Still yet another object of the present invention is to provide a horse shaped building with recreational area wherein the horse shaped building further has a tail that extends downwardly from the back of the body of the horse shaped building.

Yet still another object of the present invention is to provide a horse shaped building with recreational area wherein the tail of the horse shaped building contains conduits that function as air ducts.

Still yet another object of the present invention is to provide a horse shaped building with recreational area wherein the horse shaped building further has a pair of hind legs that extend downwardly from the bottom of the body of the horse shaped building at the back of the body of the horse shaped building to the octagonal shaped garden.

Yet still another object of the present invention is to provide a horse shaped building with recreational area wherein the horse shaped building further has a pair of front legs that extend downwardly from the bottom of the body of the horse shaped building at the front of the body of the horse shaped building to the octagonal shaped garden.

Still yet another object of the present invention is to provide a horse shaped building with recreational area wherein the body of the horse shaped building, the head of the horse shaped building, the tail of the horse shaped building, the pair of hind legs of the horse shaped building, and the pair of front legs of the horse shaped building have interior walls and exterior walls that are covered with substantially vertically disposed fireproof wooden strips.

Yet still another object of the present invention is to provide a horse shaped building with recreational area wherein the bottom of the body of the horse shaped building, the pair of hind legs of the horse shaped building, the pair of front legs of the horse shaped building, and the octagonal shaped garden define an area enclosed by facility walls that have windows.

Still yet another object of the present invention is to provide a horse shaped building with recreational area wherein the windows of the facility walls of the horse shaped building have heat efficient opaque curtains that are automatically movable on tracks therebehind.

Yet still another object of the present invention is to provide a horse shaped building with recreational area wherein the facility walls of the horse shaped building include an entry wall that has a pair of doors disposed a distance above the octagonal shaped garden.

Still yet another object of the present invention is to provide a horse shaped building with recreational area that further includes a semicircular entrance stairway that extends from the octagonal shaped garden to the pair of doors of the entry wall of the facility walls of the horse shaped buildings.

Yet still another object of the present invention is to provide a horse shaped building with recreational area therein the semicircular entrance stairway is marble of three different colors in a mosaic pattern.

Still yet another object of the present invention is to provide a horse shaped building with recreational area wherein the facility walls are reflective glass.

Yet still another object of the present invention is to provide a horse shaped building with recreational area therein the horse shaped building includes five floors.

Still yet another object of the present invention is to provide a horse shaped building with recreational area wherein a basement is disposed below the octagonal shaped garden and contains service rooms selected from the group consisting of store room, machine room, HVAC room, manager's office, toilet, and ladies room.

Yet still another object of the present invention is to provide a horse shaped building with recreational area wherein a ground floor is disposed above the octagonal shaped garden of the horse shaped building and the basement of the horse shaped building and is accessible by the pair of doors of the entry wall of the facility walls of the horse shaped building.

Still yet another object of the present invention is to provide a horse shaped building with recreational area wherein the ground floor of the horse shaped building contains at least one cafeteria and is openable to the octagonal shaped garden.

Yet still another object of the present invention is to provide a horse shaped building with recreational area wherein a mezzanine is disposed above the ground floor of the horse shaped building and contains at least one bar.

Still yet another object of the present invention is to provide a horse shaped building with recreational area wherein an A'floor is disposed above the mezzanine of the horse shaped building and contains at least one restaurant.

Yet still another object of the present invention is to provide a horse shaped building with recreational area wherein a roof garden is disposed above the A'floor of the horse shaped building.

Still yet another object of the present invention is to provide a horse shaped building with recreational area wherein a roof garden wall surrounds the roof garden of the horse shaped building.

Yet still another object of the present invention is to provide a horse shaped building with recreational area wherein the horse shaped building further has a main stairwell supplemented by an external elevator constructed of fireproof glass that extends from the basement of the horse shaped building to the roof garden of the horse shaped building.

Still yet another object of the present invention is to provide a horse shaped building with recreational area wherein the horse shaped building further has a backup stairwell that functions as a fire escape.

Yet still another object of the present invention is to provide a horse shaped building with recreational area wherein the horse shaped building further has a service lift.

Still yet another object of the present invention is to provide a horse shaped building with recreational area that further includes an exterior lighting system that highlights the horse shaped building and a boat sailable in the octagonal shaped water canal.

Yet still another object of the present invention is to provide a horse shaped building with recreational area wherein the octagonal shaped water canal is at least 8 m in width and is 1.5 m lower than the octagonal shaped garden 14 and forms a 5% slope therefrom.

Finally, still yet another object of the present invention is to provide a horse shaped building with recreational area wherein the horse shaped building has a frame selected From the group consisting of reinforced concrete, metal, and wood.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
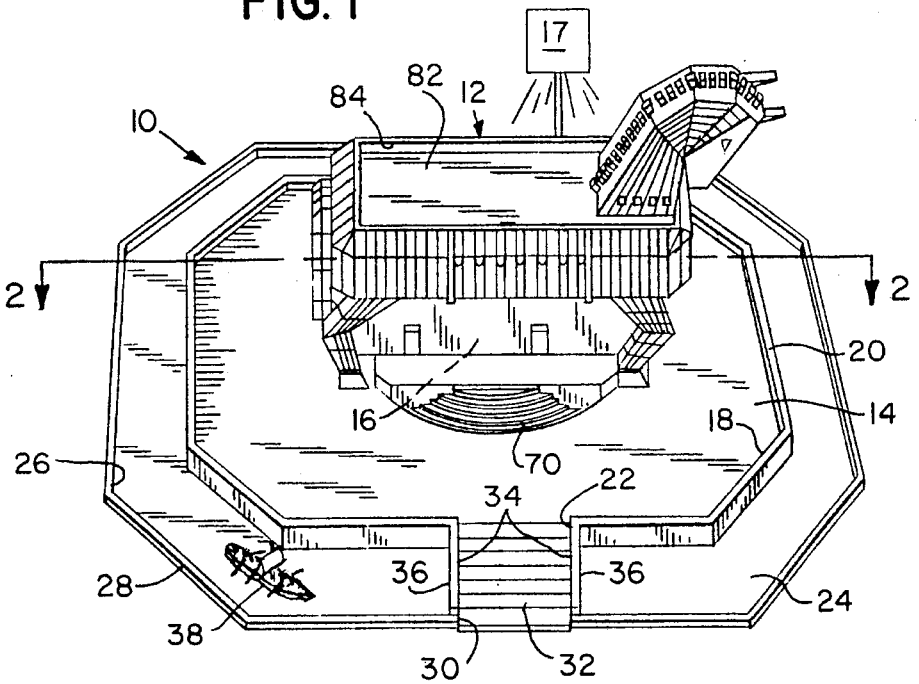
FIG. 1 is a diagrammatic perspective view of the present invention.

10 horse shaped building with recreational area of the present invention

12 horse shaped building

14 octagonal shaped garden

16 octagonal shaped garden center

17 exterior lighting system

18 octagonal shaped garden perimeter

20 octagonal shaped garden perimeter fence

22 garden perimeter fence opening

24 octagonal shaped water canal

26 octagonal shaped water canal perimeter

28 octagonal shaped water canal perimeter fence

30 water canal perimeter fence opening

32 large stepped bridge

34 pair of large stepped bridge sides

36 pair of large stepped bridge side fences

37 boat

40 horse shaped building body

42 horse shaped building body bottom

44 horse shaped building body back

46 horse shaped building body front

48 horse shaped building body top

49 plurality of horse shaped building body windows

50 horse shaped building head

52 pair of horse shaped building head eyes

54 horse shaped building head snout

55 horse shaped building head snout teeth

56 horse shaped building tail

58 pair of horse shaped building hind legs

60 pair of horse shaped building front legs

61 substantially vertically disposed fireproof wooden strips

62 facility walls

64 facility wall windows

66 facility entry wall

68 pair of facility entry wall doors

69 appropriate medallion

70 semicircular entrance stairway

74 basement

76 ground floor

78 mezzanine

80 A'floor

82 roof garden

84 roof garden walls

86 main stairwell

88 external elevator

90 backup stairwell

DETAILED DESCRIPTION OF THE PREFERRED EMBODIMENT

Figure 2:
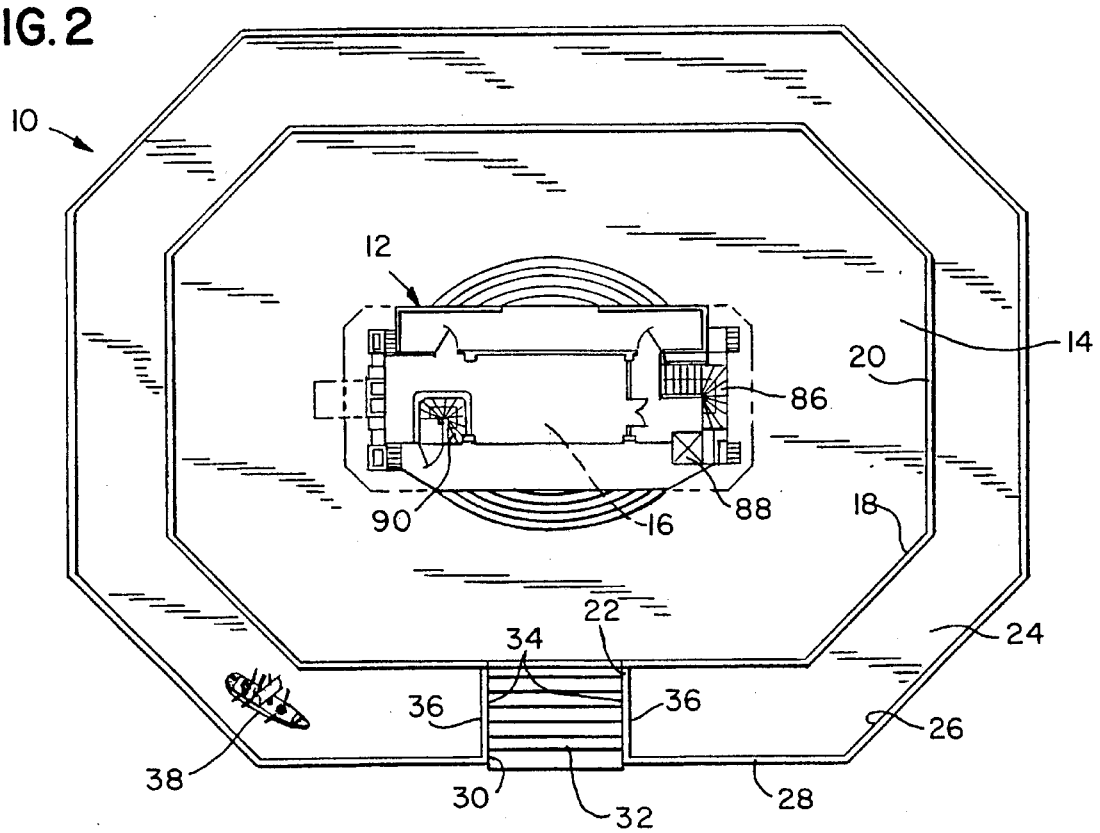
FIG. 2 is a cross sectional view taken on line 2—2 in FIG. 1.

Referring now to the figures in which like numerals indicate like parts, and particularly to FIGS. 1 and 2, the horse shaped building with recreational area of the present invention is shown generally at 10 and includes a horse shaped building 12 disposed on an octagonal shaped garden 14 substantially at an octagonal shaped garden center 16 and highlighted at night by an exterior lighting system 17.

The octagonal shaped garden 14 has an octagonal shaped garden perimeter 18 surrounded by an octagonal shaped garden perimeter fence 20 with a garden perimeter fence opening 22. The octagonal shaped garden perimeter fence 20 of the octagonal shaped garden perimeter 18 of the octagonal shaped garden 14 is a metal railing in an archaic pattern, but is not limited to that.

An octagonal shaped water canal 24 surrounds the octagonal shaped garden perimeter fence 20 of the octagonal shaped garden perimeter 18 of the octagonal shaped garden 14 and functions as a mote. The octagonal shaped water canal 24 is at least 8 m in width and is 1.5 m lower than the octagonal shaped garden 14 and forms a 5% slope therefrom.

The octagonal shaped water canal 24 has an octagonal shaped water canal perimeter 26 surrounded by an octagonal shaped water canal perimeter fence 28 with a water canal perimeter fence opening 30. The octagonal shaped water canal perimeter fence 28 of the octagonal shaped water canal perimeter 26 of the octagonal shaped water canal 24 is a metal railing in an archaic pattern, but is not limited to that.

A large stepped bridge 32 is movably disposed over the octagonal water canal 24 and extends from the garden perimeter fence opening 22 of the octagonal shaped garden perimeter fence 20 of the octagonal shaped garden perimeter 18 of the octagonal shaped garden 14 to the water canal perimeter fence opening 30 of the octagonal shaped water canal perimeter fence 28 of the octagonal shaped water canal perimeter 26 of the octagonal shaped water canal 24.

The large stepped bridge 32 has a pair of large stepped bridge sides 34. Each of a pair of large stepped bridge side fences 36 is disposed at each of the pair of large stepped bridge sides 34 of the large stepped bridge 32 and intersects the octagonal shaped garden perimeter fence 20 of the octagonal shaped garden perimeter 18 of the octagonal shaped garden 14 and the octagonal shaped water canal perimeter fence 28 of the octagonal shaped water canal perimeter 26 of the octagonal shaped water canal 24 at the extremes of the garden perimeter fence opening 22 of the octagonal shaped garden perimeter fence 20 of the octagonal shaped garden perimeter 18 of the octagonal shaped garden 14 and the extremes of the water canal perimeter fence opening 30 of the octagonal shaped water canal perimeter fence 28 of the octagonal shaped water canal perimeter 26 of the octagonal shaped water canal 24.

The pair of large stepped bridge side fences 36 of the pair of large stepped bridge sides 34 of the large stepped bridge 32 are metal railings in an archaic pattern and the pavement of the large stepped bridge 32 is marble of three different colors in a mosaic pattern, but is not limited to that.

A boat 38 in the form of ancient triiris and named ODYSSEUS can be sailed in the octagonal water canal 24. If there is another water area (not shown) in proximity to the octagonal water canal 24, a connecting water way (not shown) can be provided to connect the other water area (not shown) to the octagonal water canal 24. A shuttle service, using the boat 38 and having tickets, can be instituted on the connecting water way (not shown) to provide a short trip to and from the other water area (not shown) and the octagonal water canal 24.

The configuration of the horse shaped building 12 can best be seen in FIGS. 2–5, and as such, will be discussed with reference thereto.

The horse shaped building 12 assures static strength by the use of a specifically constructed frame (not shown) of either reinforced concrete, metal, or wood, depending upon availability.

The horse shaped building 12 includes a horse shaped building body 40 with a horse shaped building body bottom 42, a horse shaped building body back 44, a horse shaped building body front 46, a horse shaped building body top 48, and a plurality of horse shaped building body windows 49.

A horse shaped building head 50 is disposed on the horse shaped building body top 48 of the horse shaped building body 40 of the horse shaped building 12 at the horse shaped building body front 46 of the horse shaped building body 40 of the horse shaped building 12 and extends upwardly therefrom. The horse shaped building head 50 of the horse shaped building 12 has a pair of horse shaped building head eyes 52 and a horse shaped building head snout 54. The horse shaped building head snout 54 of the horse shaped building head 50 of the horse shaped building 12 has horse shaped building head snout teeth 55 and is rotatively mounted to the horse shaped building head 50 of the horse shaped building 12.

The horse shaped building head eyes 52 of the horse shaped building head 50 of the horse shaped building 12 and the horse shaped building head snout teeth 55 of the horse shaped building head snout 54 of the horse shaped building head 50 of the horse shaped building 12 function as windows. A head stairway (not shown) leads from the horse shaped building body top 48 of the horse shaped building body 40 of the horse shaped building 12 through the horse shaped building head 50 of the horse shaped building 12 to a platform (not shown) at the pair of horse shaped building head eyes 52 of the horse shaped building head 50 of the horse shaped building 12 and to a platform (not shown) at the horse shaped building head snout 54 of the horse shaped building head 50 of the horse shaped building 12.

The presence of the head stairway (not shown), the horse shaped building head eyes 52 of the horse shaped building head 50 of the horse shaped building 12, the horse shaped building head snout teeth 55 of the of the horse shaped building head snout 54 of the horse shaped building head 50 of the horse shaped building 12 functioning as windows, and the rotatabilty of the horse shaped building head snout 54 of the horse shaped building head 50 of the horse shaped building 12 allow visitors to participate in a short scenic visit, if so desired.

A horse shaped building tail 56 is disposed on the horse shaped building body back 44 of the horse shaped building body 40 of the horse shaped building 12 and extends downwardly therefrom. The horse shaped building tail 56 of the horse shaped building 12 contains conduits (not shown) that function as air ducts so that the space in the horse shaped building tail 56 of the horse shaped building 12 is useful and functional.

A pair of horse shaped building hind legs 58 are disposed on the horse shaped building body bottom 42 of the horse shaped building body 40 of the horse shaped building 12 at the horse shaped building body back 44 of the horse shaped building body 40 of the horse shaped building 12 and extend downwardly therefrom to the octagonal shaped garden 14.

A pair of horse shaped building front legs 60 are disposed on the horse shaped building body bottom 42 of the horse shaped building body 40 of the horse shaped building 12 at the horse shaped building body front 46 of the horse shaped building body 40 of the horse shaped building 12 and extend downwardly therefrom to the octagonal shaped garden 14.

The horse shaped building body 40 of the horse shaped building 12, the horse shaped building head 50 of the horse shaped building 12, the horse shaped building tail 56 of the horse shaped building 12, the pair of horse shaped building hind legs 58 of the horse shaped building 12, and the pair of horse shaped building front legs 60 of the horse shaped building 12 are covered on their interiors with substantially vertically disposed fireproof wooden strips 61 for fire protection and on their exteriors for fire protection and for proper water runoff.

To accommodate additional facilities, the area between the horse shaped building body bottom 42 of the horse shaped building body 40 of the horse shaped building 12, the pair of horse shaped building hind legs 58 of the horse shaped building 12, the pair of horse shaped building front legs 60 of the horse shaped building 12, and the octagonal shaped garden 14 is enclosed by facility walls 62 that have facility wall windows 64.

The facility walls 62 of the horse shaped building 12 include a facility entry wall 66 that has a pair of facility entry wall doors 68 disposed a distance above the octagonal shaped garden 14 for allowing entrance to the horse shaped building 12. An appropriate medallion 69 such as a Greek figure, may be disposed on the facility entry wall 66 of the facility walls 62 of the horse shaped building 12 above and intermediate the pair of facility entry wall doors 68 of the facility entry wall 66 of the facility walls 62 of the horse shaped building 12.

A semicircular entrance stairway 70 extends from the octagonal shaped garden 14 to the pair of facility entry wall doors 68 of the facility entry wall 66 of the facility walls 62 of the horse shaped building 12 to assist in the entrance. The semicircular entrance stairway 70 of the horse shaped building 12 may be marble of three different colors in a mosaic pattern, but is not limited to that.

The facility walls 62 of the horse shaped building 12 are reflective glass to afford privacy. In the night, however, privacy is afforded by heat efficient opaque curtains (not shown) that are automatically movable on tracks (not shown) disposed behind the facility wall windows 64 of the facility walls 62 of the horse shaped building 12.

Figure 3:
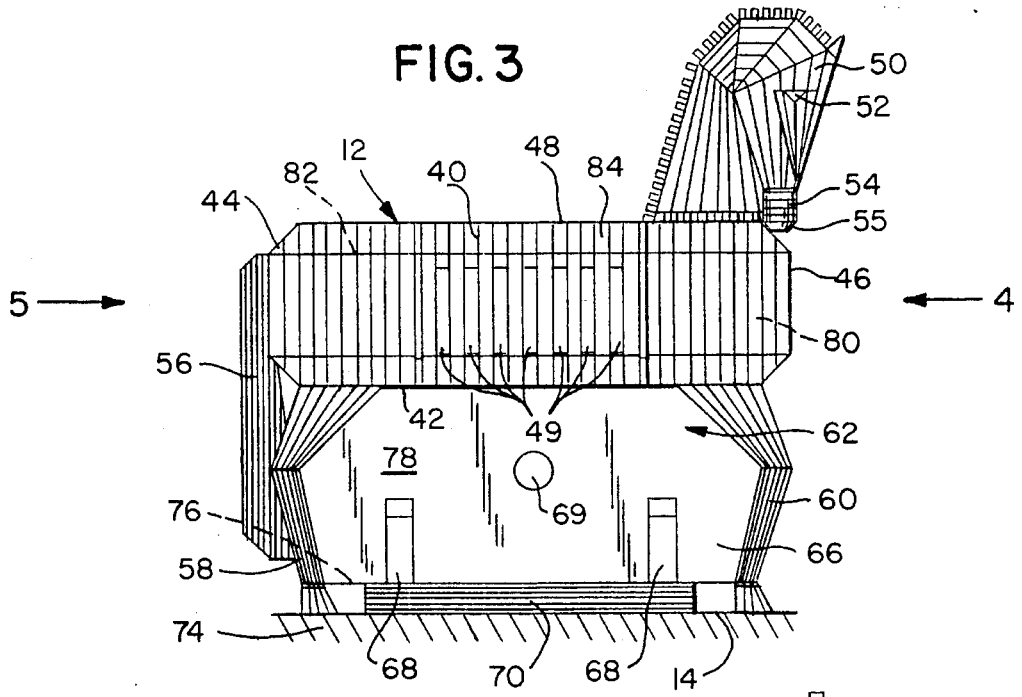
FIG. 3 is a diagrammatic side elevational view of the horse shaped building of the present invention.
Figure 4:
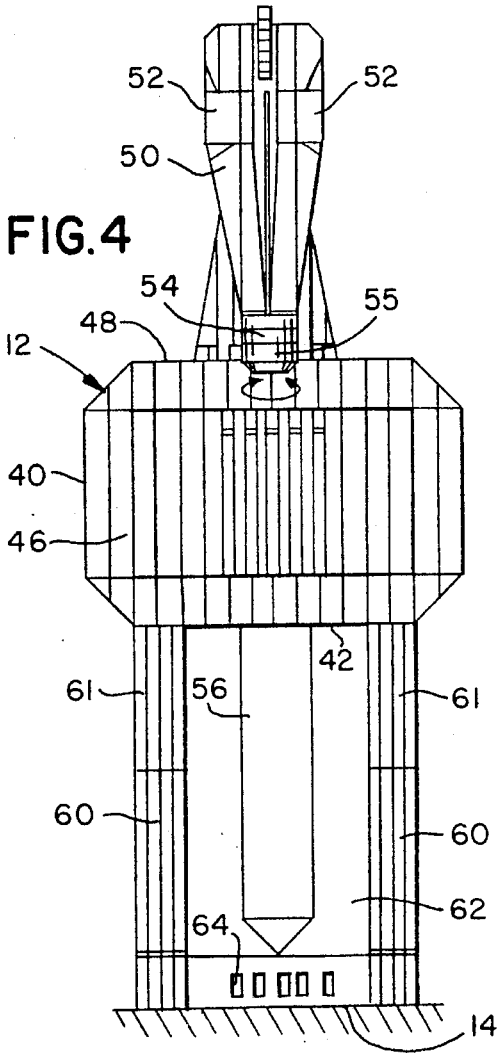
FIG. 4 is a diagrammatic front elevational view taken in the direction of arrow 4 in FIG. 3.
Figure 5:
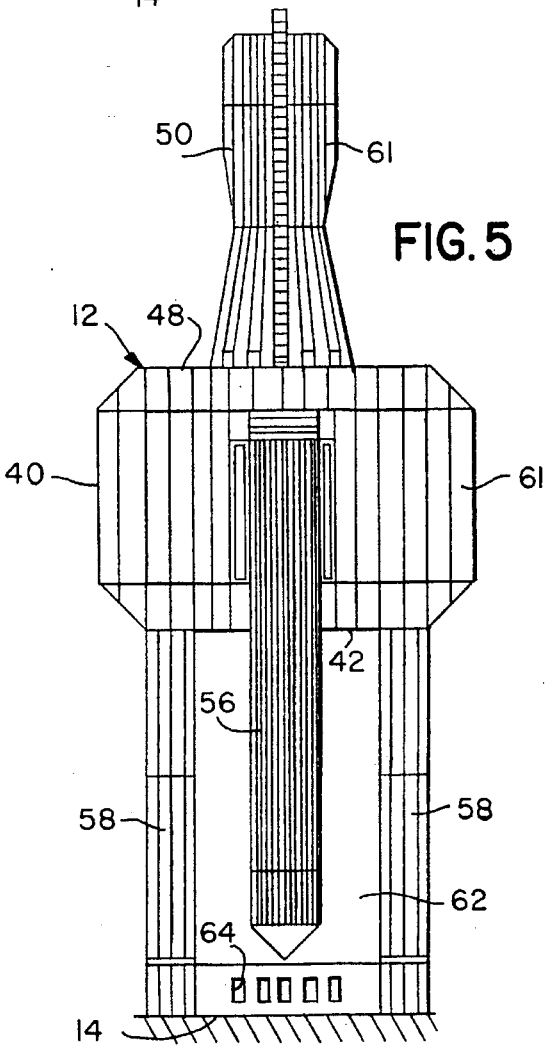
FIG. 5 is a diagrammatic rear elevational view taken in the direction of arrow 5 in FIG. 3.

As shown in FIG. 3, the horse shaped building 12 includes four main floors. A basement 74 is disposed below the octagonal shaped garden 14 and contains service rooms (not shown) such as, but not limited to, kitchen(s), store room(s), machine room(s), HVAC room(s), manager's office(s), toilet(s), and ladies room(s).

A ground floor 76 is disposed above the octagonal shaped garden 14 and accessible by the pair of facility entry wall doors 68 of the facility entry wall 66 of the facility walls 62 of the horse shaped building 12. The ground floor 76 of the horse shaped building 12 contains rooms (not shown) such as, but not limited to, cafeteria(s) and is openable to the octagonal shaped garden 14 so that during warm weather the cafeteria(s) can be extended outdoors.

A mezzanine 78 is disposed above the ground floor 76 of the horse shaped building 12 and contains rooms (not shown) such as, but not limited to, bars(s).

An A'floor 80 is disposed above the mezzanine 78 of the horse shaped building 12 and contains rooms (not shown) such as, but not limited to, restaurant(s).

As best seen in FIGS. 1 and 3, a roof garden 82 is disposed above the A'floor 80 of the horse shaped building 12 and can be used as the summer part of the restaurant of the A'floor 80 of the horse shaped building 12 and/or for visitors to view the surrounding area. Roof garden walls 84 surround the roof garden 82 of the horse shaped building 12 and function to protect against visitor falling. The roof garden 82 of the horse shaped building 12 may be marble of three different colors in a mosaic pattern, but is not limited to that.

As shown in FIG. 2, access from the ground floor 76 of the horse shaped building 12 to the basement 74 of the horse shaped building 12, to the mezzanine 78 of the horse shaped building 12, to the A'floor 80 of the horse shaped building 12, and to the roof garden 82 of the horse shaped building 12 is achieved by a main stairwell 86 supplemented by an external elevator 88 constructed of fireproof glass. A backup stairwell 90 is provided that functions as a fire escape.

A service lift (not shown) is provided for access from the kitchen(s) of the basement 74 of the horse shaped building 12 to the cafeteria(s) of the ground floor 76 of the horse shaped building 12, to the bar(s) of the mezzanine 78 of the horse shaped building 12, and to the restaurant(s) of the A'floor 80 of the horse shaped building 12.

It will be understood that each of the elements described above, or two or more together, may also find a useful application in other types of constructions differing from the types described above.

While the invention has been illustrated and described as embodied in a horse shaped building with recreational area, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A horse shaped building with recreational area, comprising:

a) an octagonal shaped garden;

b) a horse shaped building disposed on said octagonal shaped garden;

c) an octagonal shaped water canal surrounding said octagonal shaped garden; and d) a movably mounted stepped bridge extending from said octagonal shaped garden and passing over said octagonal shaped water canal.

2. The horse shaped building with recreational area as defined in claim 1, wherein said octagonal shaped garden has a perimeter surrounded by a fence with an opening.

3. The horse shaped building with recreational area as defined in claim 1, further comprising an exterior lighting system to highlight the horse shaped building and a boat sailable in said octagonal water canal, said octagonal shaped water canal is at least 8 m in width and is 1.5 m lower than the octagonal shaped garden and forms a 5% slope therefrom, said horse shaped building has a frame selected from the group consisting of reinforced concrete, metal, and wood.

4. The horse shaped building with recreational area as defined in claim 2, wherein said fence of said perimeter of said octagonal shaped garden is a metal railing.

5. The horse shaped building with recreational area as defined in claim 2, wherein said octagonal shaped water canal has a perimeter surrounded by a fence with an opening.

6. The horse shaped building with recreational area as defined in claim 5, wherein said fence of said perimeter of said octagonal shaped water canal is a metal railing.

7. The horse shaped building with recreational area as defined in claim 5, wherein said movably mounted stepped bridge extends from said opening of said fence of said perimeter of said octagonal shaped garden to said opening of said perimeter of said fence of said octagonal shaped water canal.

8. The horse shaped building with recreational area as defined in claim 7, wherein said stepped bridge has a pair of sides, each of a pair of fences is disposed at each of said pair of sides of said stepped bridge, each of said pair of fences of said pair of sides of said stepped bridge intersects said fence of said perimeter of said octagonal shaped garden and said fence of said perimeter of said octagonal shaped water canal at extremes of said opening of said fence of said perimeter of said octagonal shaped garden and at extremes of said opening of said fence of said perimeter of said octagonal shaped water canal.

9. The horse shaped building with recreational area as defined in claim 8, wherein each of said pair of fences of said pair of sides of said stepped bridge are metal railings and the stepped bridge is marble of three different colors in a mosaic pattern.

10. The horse shaped building with recreational area as defined in claim 9, wherein said horse shaped building includes a body with a bottom, a back, a front, a top, and a plurality of windows, a head extends upwardly from said top of said body of said horse shaped building at said front of said body of said horse shaped building, said head of said horse shaped building has a pair of eyes and a snout with teeth, said snout of said head of said horse shaped building is rotatively mounted in said head of said horse shaped building, said pair of eyes of said head of said horse shaped building and said teeth of said snout of said head of said horse shaped building function as windows.

11. The horse shaped building with recreational area as defined in claim 10, wherein said head of said horse shaped building further has a stairway that extends from said top of said body of said horse shaped building through said head of said horse shaped building to a platform at said pair of eyes of said head of said horse shaped building and to a platform at said snout of said head of said horse shaped building.

12. The horse shaped building with recreational area as defined in claim 11, Wherein said horse shaped building further has a tail that extends downwardly from said back of said body of said horse shaped building, said tail of said horse shaped building contains conduits that function as air ducts.

13. The horse shaped building with recreational area as defined in claim 12, wherein said horse shaped building further has a pair of hind legs that extend downwardly from said bottom of said body of said horse shaped building at said back of said body of said horse shaped building to said octagonal shaped garden.

14. The horse shaped building with recreational area as defined in claim 13, wherein said horse shaped building further has a pair of front legs that extend downwardly from said bottom of said body of said horse shaped building at said front of said body of said horse shaped building to said octagonal shaped garden.

15. The horse shaped building with recreational area as defined in claim 14, wherein said body of said horse shaped building, said head of said horse shaped building, said tail of said horse shaped building, said pair of hind legs of said horse shaped building, and said pair of front legs of said horse shaped building have interior walls and exterior walls that are covered with substantially vertically disposed fireproof wooden strips.

16. The horse shaped building with recreational area as defined in claim 14, wherein said bottom of said body of said horse shaped building, said pair of hind legs of said horse shaped building, said pair of front legs of said horse shaped building, and said octagonal shaped garden define an area enclosed by facility walls that have windows, said windows of said facility walls of said horse shaped building have heat efficient opaque curtains that are automatically movable on tracks therebehind, said facility walls of said horse shaped building include an entry wall that has a pair of doors disposed a distance above said octagonal shaped garden.

17. The horse shaped building with recreational area as defined in claim 16, further comprising a semicircular entrance stairway that extends from said octagonal shaped garden to said pair of doors of said entry wall of said facility walls of said horse shaped building.

18. The horse shaped building with recreational area as defined in claim 17, wherein said semicircular entrance stairway of said horse shaped building is marble of three different colors in a mosaic pattern, and said facility walls of said horse shaped building are reflective glass.

19. The horse shaped building with recreational area as defined in claim 18, wherein said horse shaped building includes five floors, a basement disposed below said octagonal shaped garden that contains service rooms selected from the group consisting of store room, machine room, HVAC room, manager's office, toilet, and ladies room, a ground floor disposed above said octagonal shaped garden that is accessible by said pair of doors of said entry wall of said facility walls of said horse shaped building, said ground floor of said horse shaped building contains at least one cafeteria and is openable to said octagonal shaped garden, a mezzanine disposed above said ground floor of said horse shaped building that contains at least one bar, an a floor disposed above said mezzanine of said horse shaped building that contains at least one restaurant, and a roof garden disposed above said floor of said horse shaped building, a roof garden wall surrounds said roof garden of said horse shaped building.

20. The horse shaped building with recreational area as defined in claim 19, wherein said horse shaped building further has a main stairwell supplemented by an external elevator constructed of fireproof glass that extends from said basement of said horse shaped building to said roof garden of said horse shaped building, a backup stairwell that functions as a fire escape, and a service lift.

* * * * *